US006101944A

United States Patent [19]

Schmid et al.

[11] Patent Number: 6,101,944

[45] Date of Patent: Aug. 15, 2000

[54] METHOD FOR OPERATING A ROTARY PRINTING PRESS AND DEVICE FOR CARRYING OUT THE METHOD

[75] Inventors: Gotthard Schmid, Malsch, Germany; John Sheridan Richards, Barrington, N.H.

[73] Assignee: Heidelberger Druckmaschinen Aktiengesellschaft, Heidelberg, Germany

[21] Appl. No.: 09/165,605

[22] Filed: Oct. 2, 1998

[30] Foreign Application Priority Data

Oct. 2, 1997 [DE] Germany ..... 197 43 770

[51] Int. Cl.[7] ..... B41M 5/00; B41M 5/26; B41N 3/00; B41N 1/00

[52] U.S. Cl. ..... 101/467; 101/463.1; 101/478

[58] Field of Search ..... 101/401.1, 456, 101/463.1, 465–467, 457, 395, 450.1, 478; 399/364; 430/330, 346, 347, 300, 301–307

[56] References Cited

U.S. PATENT DOCUMENTS

| | | | |
|---|---|---|---|
| 4,346,656 | 8/1982 | Schwaab et al. | 101/181 |
| 5,012,735 | 5/1991 | Fischer et al. . | |
| 5,072,671 | 12/1991 | Schneider et al. . | |
| 5,191,836 | 3/1993 | Weis . | |
| 5,305,019 | 4/1994 | Orth et al. . | |
| 5,351,617 | 10/1994 | Williams et al. . | |
| 5,816,161 | 10/1998 | Nussel et al. | 101/458 |

FOREIGN PATENT DOCUMENTS

| | | | |
|---|---|---|---|
| 0 639 452 A1 | 2/1995 | European Pat. Off. . | |
| 0 867 279 A1 | 9/1998 | European Pat. Off. . | |
| 1 039 5378 | 9/1958 | Germany . | |
| 2 033 836 | 1/1972 | Germany . | |
| 28 44 418 C3 | 2/1982 | Germany . | |
| 38 37 898 A1 | 6/1990 | Germany . | |
| 38 25 145 C1 | 2/1991 | Germany . | |
| 41 03 744 C1 | 9/1992 | Germany . | |
| 195 03 619 A1 | 8/1996 | Germany . | |
| 195 12 420 | 10/1996 | Germany | 101/181 |
| 195 12 420 A1 | 10/1996 | Germany . | |
| 195 23 378 | 1/1997 | Germany | 101/181 |
| 195 33 811 A1 | 3/1997 | Germany . | |
| 196 02 289 A1 | 7/1997 | Germany . | |
| 196 03 663 A1 | 8/1997 | Germany . | |
| 2 253 372 | 9/1992 | United Kingdom . | |
| 2 309 668 | 8/1997 | United Kingdom . | |

OTHER PUBLICATIONS

International Patent Application WO 92/12011 (Pensavecchia et al.), dated Jul. 23, 1992.

International Patent Application WO 97/02143 (Bolza–Shünemann), dated Jan. 23, 1997.

*Primary Examiner*—Kimberly Asher

[57] ABSTRACT

A method of operating a rotary printing press, wherein, during printing with a first printing form, a second printing form is imaged. A device for implementing the method has at least one imaging apparatus associated with the printing forms.

19 Claims, 3 Drawing Sheets

METHOD FOR OPERATING A ROTARY PRINTING PRESS AND DEVICE FOR CARRYING OUT THE METHOD

BACKGROUND OF THE INVENTION

Field of the Invention

The invention relates to a method of operating a rotary printing press with at least two printing forms. The printing forms are imageable in the printing press and allow a number of prints to be made after a single imaging. The invention further relates to a device for carrying out the process.

Published German patent application DE 195 12 420 A1 discloses a multi-color printing press with an imaging unit that can be assigned successively to a plurality of printing-form cylinders. This reduces costs in comparison with a system in which a separate imaging apparatus is assigned to each printing-form cylinder. No provisions are made for an imaging of printing forms during the operation of the printing press. As a consequence the operation must be interrupted for each new print job. The resulting waste paper when operation is resumed, combined with the high total of downtimes, causes a comparatively poor economic efficiency.

German patent DE-PS 28 44 418 describes a web-fed rotary printing press with a flying change of the printing image in an imprinting unit. When a defined number of copies have been printed with a first imprinting image, the presently operating printing unit is shut down and a further printing unit of the imprinting unit is put into operation without stopping the press. While the further printing unit is in operation, the shut-down printing unit can be prepared for the next imprint. No provision is made for an imaging of printing forms in the printing press. As a consequence, in the case of small numbers of copies per printed image, the pre-press costs, e.g. the photochemical plate exposure, constitute a comparatively large proportion of the total costs. An automated change of the printing plates can be accomplished only with considerable technical effort.

SUMMARY OF THE INVENTION

It is accordingly an object of the invention to provide a method and a device for operating a rotary printing press, which overcomes the hereinafore-mentioned disadvantages of the heretofore-known methods of this general type and with which it is possible to carry out partial runs with small numbers of copies economically with a low waste rate and a good utilization of the press capacity.

With the foregoing and other objects in view there is provided, in accordance with the invention, a method of operating a rotary printing press, which comprises providing a first printing form and a second printing form; imaging the first printing form in a rotary printing press; printing a plurality of prints with the first printing form; and imaging the second printing form in the rotary printing press during the printing with the first printing form.

In accordance with another feature of the invention, the method comprises changing on the fly from the first printing form to the second printing form for an uninterrupted printing operation.

In accordance with a further feature of the invention, the imaging steps comprise locally irradiating the first and the second printing forms, respectively.

In accordance with yet another feature of the invention, the method comprises cleaning the first and the second printing forms from imaging residues after the respective irradiating steps.

With the foregoing and other objects in view there is also provided, in a rotary printing press, a device for printing with a first and a second printing form, comprising a first and a second printing form for printing a plurality of prints; a first imaging apparatus for imaging the first printing form; a second imaging apparatus for imaging the second printing form; and an imaging control apparatus connected to the first imaging apparatus and to the second imaging apparatus and controlling the second imaging apparatus for imaging the second printing form in the rotary printing press during a printing with the first printing form.

With the foregoing and other objects in view there is furthermore provided, in a rotary printing press, a device for printing with a first and a second printing form, comprising a first and a second printing form for printing a plurality of prints; a common imaging apparatus selectively imaging the first printing form and the second printing form; and an imaging control apparatus connected to the common imaging apparatus and controlling the common imaging apparatus for imaging the second printing form in the rotary printing press during a printing with the first printing form.

In accordance with a further feature of the invention, the common imaging apparatus is movable selectively into a first position for imaging the first printing form and into a second position for imaging the second printing form.

In accordance with another feature of the invention, the common imaging apparatus is pivotally movable selectively into the first position and the second position.

In accordance with yet another feature of the invention, the first printing form is integrated in a first imprinting apparatus and the second printing form is integrated in a second imprinting apparatus.

In accordance with a further feature of the invention, the first and the second imaging apparatuses each include a laser write head.

In accordance with another feature of the invention, the common imaging apparatus includes a laser write head.

In accordance with yet another feature of the invention, the device for printing with a first and a second printing form operates in a multi-color sheet-fed offset rotary printing press.

The method of operating a rotary printing press in accordance with the invention, requires at least two printing forms. The printing forms are imageable in the printing press and allow a plurality of prints to be made after a one-off imaging. The second printing form is imaged while the first printing form is printing. The second printing form is advantageously imaged for a printing process in which the second printing form prints after the first printing form.

In a preferred device for carrying out the method in accordance with the invention, the first printing form is assigned to a first imaging apparatus and the second printing form is assigned to a second imaging apparatus.

Alternatively, the first printing form and the second printing form are assigned to a single common imaging apparatus. The single common imaging apparatus may be used for imaging the first and second printing forms.

The method in accordance with the invention can be employed in the operation of web-fed and sheet-fed rotary printing presses. The devices carrying out the method of the invention can be used in these printing presses.

In contrast to the dynamic or erasable printing forms in printers and plotters used as output devices for personal computers and operating, e.g. according to the electrographical principle, the invention relates to printing forms which are imaged once with a storable, non-erasable image. Such printing forms are associated with the so-called master system. These printing forms may be attached to or applied on printing-form cylinders in the form of a printing plate, a sleeve or a curable fluid film or, preferably, in the form of a printing foil wound onto the printing-form cylinder. The printing forms may be offset printing forms, e.g. conventional wet-offset printing forms or dry-offset printing forms using no damping solution, or, alternatively, direct-lithography (dilitho) printing forms.

The direct imaging of the printing forms may be accomplished according to a computer-to-press imaging process. This imaging process comprises a local or pixel-wise irradiation or illumination. Preferably, a high-energy irradiation or illumination is used. A subsequent manual or automatic cleaning of the printing form removes imaging residues, e.g. thermally decomposed material of a non-printing layer of the printing form. As a result, a printing layer is exposed and activated at the image areas. The non-printing layer of the printing form may be a silicone layer and the printing layer may be an infra-red absorption layer.

The printing form may be cleaned by means of a cleaning apparatus or by the printing substrate. The subsequently to be printed printing substrate may be used for the purpose of cleaning. Also, a printing substrate consisting of a material specially provided for cleaning may be used. The imaging residues may be removed from the printing substrate directly during the start of printing, e.g. by just a few waste sheets, or in a cleaning operation prior to printing. In the case of non-ablative imaging processes, there is no need for a cleaning process to follow the actual imaging process. Instead, the imaging may be followed by other processes for making the printing form ready for press.

Depending on the particular imaging process, the complete imaging of the printing form requires a certain length of time, e.g. 12 minutes. The irradiation of the printing form may take 6 minutes, the cleaning may also take 6 minutes.

The total run of a printed product may consist of a first partial run, which is to be provided with one image or imprint, and of a second partial run, which is to be provided with another image or imprint. During the production of the first partial run using the first printing form, which prints the first image or imprint, the second printing form can be imaged, e.g. irradiated and cleaned, in the printing press. If the production of the first partial run requires a very small amount of time, less than 12 minutes in the aforementioned example, it may be the case that the imaging of the second printing form has not yet been completed upon termination of the first partial run, with the consequence that the printing press may stand still while imaging is being completed. In such a case, the second printing form is imaged in part during printing with the first printing form. Usually, however, the printing of the first partial run requires far more time than is needed in total for the imaging operation, with the result that the imaging operation can be fully completed during the printing of the first partial run.

In this case, there may be a flying change between printing with the first printing form and printing with the second printing form. For this purpose, a second printing apparatus, comprising the second printing form, is accelerated to production speed by a driving apparatus. The second printing apparatus is synchronized with the rotational speed of the printing press and is coupled to the main drive of the printing press. The second printing form is brought into the printing position. The first printing form can be taken out of the printing position and the first printing apparatus, comprising the first printing form, can be uncoupled from the main drive, so that the first printing apparatus can be decelerated to a stop or until it reaches a lower speed (crawl speed). The aforedescribed flying change can be effected during the uninterrupted operation of a third printing apparatus or printing unit or during the uninterrupted operation of a plurality of further printing apparatuses or printing units comprised by the printing press. The last-mentioned further printing units may print the actual printed image of the overall run of the job, with the first and second printing apparatuses acting as imprinting units, which may print additional imprints onto the actual printed image. The further printing units may comprise conventional printing forms which may, for example, be imaged by means of plate exposure outside the printing press and not inside the printing press.

In the case of jobs with more than two partial runs, there may be an alternate imaging and an alternate use of the first and second printing forms. Of course, the method may also be implemented using more than two printing forms imageable in the printing press, with, for example, a first printing form being in use while a second printing form and a third printing form are being imaged. After completing the partial run printed with the first printing form, there is a change of printing units. The following prints or imprints are made with the second printing form, while the imaging of the first printing form commences and the imaging of the third printing form is ended. The first and second imaging apparatuses of the device carrying out the method of the invention may be controlled by an electronic control apparatus. The imaging apparatuses may each be controlled by a separate electronic control apparatus or by a single optionally selectable common electronic control apparatus. The control apparatus may contain, for example, a microprocessor and may accept bitmap files from electronic-publishing systems, e.g. from a halftone-image processor or a raster-image processor. These digital data are forwarded to the e.g. one row of eleven write heads of the imaging apparatuses. The write heads comprise laser diodes or electrodes generating electroerosive sparks. A common or jointly used imaging apparatus of the device according to the invention can be selectively assigned to the respective printing form by a selective attachment or mounting. It is possible to change for instance from a first holder or support, associated with the first printing form, over to a second holder associated with the second printing form. Preferably, the common imaging apparatus can be moved, e.g. slid, rotated, or swivelled, into a first position for imaging the first printing form and into a second position for imaging the second printing form. The common imaging apparatus may be moved into further positions or allocated to further positions, such as an imaging position for imaging a third or further printing forms or a neutral position for cleaning the second printing form during the use of the first printing form.

A preferred embodiment of the invention may be designed such that in-line imprints are printed onto an already printed image. For this purpose, a rotary printing press may be designed such that, viewed in the conveying direction of the substrate, two imprinting apparatuses are disposed after the printing units required for one- or two-sided four- or more-color printing. Each of the imprinting apparatuses may comprise a printing-form cylinder or a printing-form and rubber-blanket-cylinder combination. The printing-form cylinder and the printing-form and rubber-blanket-cylinder combination may be engageable with and disengageable from an impression cylinder.

The method according to the invention may be used in a printing press with four printing units for two-color printing. Each printing unit comprises a printing form which can be imaged in the printing press. During the printing of a first two-color-job with a first and a second printing unit, the third and fourth printing units are being imaged for a subsequent second two-color-job. In this manner, printing presses with a large number of printing units can be utilized economically for jobs involving small numbers of colors to be printed, in particular, four-color printing presses for two-color-jobs or perfecting presses with eight printing units and a turning apparatus for two-sided printing in one pass for one-sided four-color-jobs.

Other features which are considered as characteristic for the invention are set forth in the appended claims.

Although the invention is illustrated and described herein as embodied in method for operating a rotary printing press and a device carrying out the method, it is nevertheless not intended to be limited to the details shown, since various modifications and structural changes may be made therein without departing from the spirit of the invention and within the scope and range of equivalents of the claims. The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
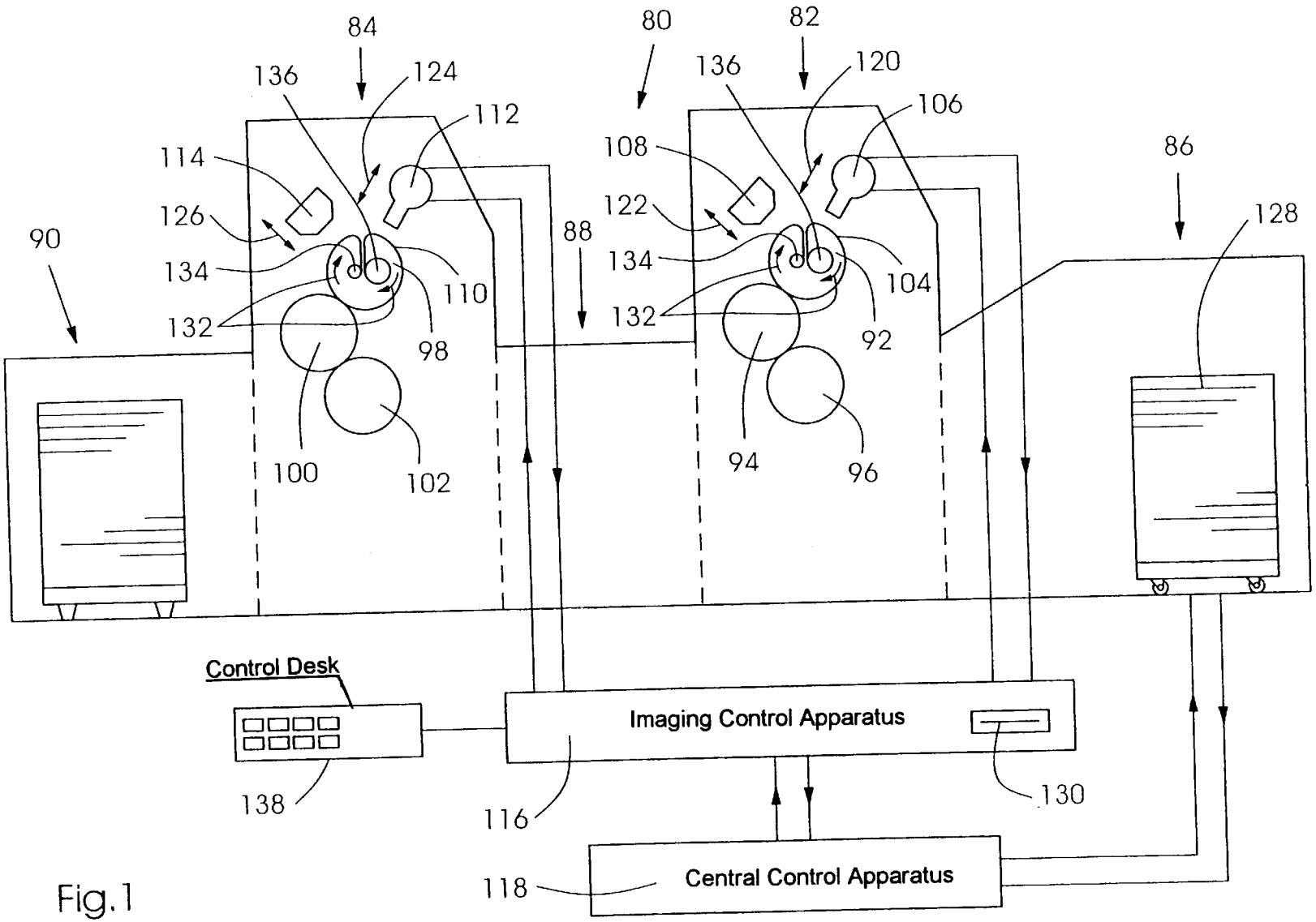
FIG. 1 is a schematic representation of an in-line rotary printing press with a device for carrying out the method according to the invention.

Referring now to the figures of the drawings in detail and first, particularly, to FIG. 1 thereof, there is schematically illustrated an in-line rotary printing press with a device for carrying out the method according to the invention. The rotary printing press comprises a first printing unit 82, a second printing unit 84, a sheet feeder 86, a sheet-transfer and/or sheet-turning apparatus 88, a sheet delivery 90 and a central control apparatus 118 for the control of the aforementioned components of the printing press including the (not shown in FIG. 1) drives of the components as well as the (not shown) inking or inking and damping units associated with the printing units 82, 84. Each of the printing units 82, 84 comprises an impression cylinder 96, 102, a rubber-blanket cylinder 94, 100 and a printing-form cylinder 92, 98 with a printing form 104, 110. The printing forms 104, 110 are each associated with a cleaning apparatus 108, 114 and an imaging apparatus 106, 112. The imaging apparatuses 106, 112 may comprise a laser, a modulator disposed thereafter as well as a fiber-optics system transmitting the modulated radiation to a focusing-optics system. The focusing-optics system may run in spiral manner across the surface of the printing form 104, 110 on the rotating printing-form cylinder 92, 98, where the laser beam drills the desired dots or small indentations at the positions of the raster. The imaging apparatuses 106, 112 are controlled by an imaging control apparatus 116 which, in a first operating mode, controls the first imaging apparatus 106 and, in a second operating mode, controls the second imaging apparatus 112 and which is connected to the central control apparatus 118. The central control apparatus 118 is connected to a control desk 138 which is used in a known manner to enter operating parameters and commands in order to control the printing press. It is likewise possible to employ an imaging control apparatus 116 separate from the central control apparatus 118 or a system of imaging control through the central control apparatus 118.

The printing-form cylinders 92, 98 can be moved into an imaging position in which they do not contact the rubber-blanket cylinders 94, 100 when an imaging is to be carried out. Positioning means for positioning 120, 124 the imaging apparatuses 106, 112 may additionally be provided. Thus, a suitable imaging distance between the effective elements of the imaging apparatuses 106, 112, e.g. laser diodes or a focusing-optics system, and the surface of the printing forms 104, 110 can be set and kept constant. As a result, a precisely defined diameter of the halftone or raster dots or indentations is achieved. The cleaning apparatuses 108, 114 can likewise be positioned 122, 126 and may be in the form of a cleaning cloth that can be wound or unwound. The cleaning cloth may be provided in combination with a pressing-on element. The pressing-on element presses the cleaning cloth against the surface of the printing form. A cleaning fluid may be directly applied to the surface of the printing form or indirectly through the intermediary of the cleaning apparatus.

Hereinbelow, the implementation of the method according to the invention is explained by way of example for the assumed case that two print jobs are being processed. The first print job is printed with the second printing unit 84 using the already imaged second printing form 110. The sheets 128 are conveyed from the sheet feeder 86 to the first printing unit 82, from there via the sheet-transfer apparatus 88 to the second printing unit 84 and via the latter to the sheet delivery 90. While the sheets 128 are being printed in the second printing unit 84, the first printing form 104 is imaged in the first printing unit 82 for the second print job, which is to be processed after the first print job. During the imaging of the first printing form 104, the printing-form cylinder 92 is disengaged from the rubber-blanket cylinder 94. Thus it is possible for the rubber-blanket cylinder 94 to be either in or out of engagement with the impression cylinder 96. The processing of the complete production run of the first print job may require a length of time that is sufficiently long for imaging the first printing form 104. As a result, it may be possible to carry out the entire imaging during that length of time. This may include burning all halftone or raster dots or pixels into the first printing form 104 as well as the subsequent removal of the printing-form material, which was thermally decomposed in the course of ablative imaging, from the first printing form 104 by means of the cleaning apparatus 108. After the processing of the first print job, the processing of the second print job is started. For this purpose, the printing-form cylinder 92 is brought into a working position in which there is cooperation with the rubber-blanket cylinder 94 and, at the same time, the printing-form cylinder 98 is brought out of such a working position into an imaging position. Such a flying change of printing forms minimizes the amount of waste and, if necessary, a brief intermediate washing of the rubber-blanket cylinder 100 and/or removal of its contact with the impression cylinder 102 is also possible. The printing forms 104, 110, which are preferably in the form of rolls of printing foil, can be renewed by a printing foil feed 132 in that imaged and used areas of a printing foil are wound onto a first roll 134 and fresh imageable sections of printing foil are unwound from a second roll 136. Thereafter, the second printing form 110 can be imaged during the processing of the second print job in the first printing unit 82.

The imaging control apparatus 116 can be set manually or, as shown, by the central control apparatus 118 selectively to a first operating mode and a second operating mode. The first operating mode controls the first imaging apparatus 106 for imaging the first printing form 104, the second operating mode controls the second imaging apparatus 112 for imaging the second printing form 110. The imaging control apparatus 116 receives image data and other data for imaging the printing forms 104, 110 on-line from electronic-publishing systems provided upstream in the data flow or, as shown, from transportable data-storage media 130, e.g. diskettes. Connecting the imaging control apparatus 116 to the central control apparatus 118 or integrating the imaging control apparatus 116 in the central control apparatus 118 permit a further use of the image data for controlling further printing-press components. Examples are the image-specific adjustment of the inking unit and a flow of signals to the imaging control apparatus 116 wherein the signals relate to instantaneous operating states of the printing press 80, particularly of the printing units 82, 84. Furthermore, the optional connection of the imaging control apparatus 116 to the imaging apparatuses 106, 112 as well as the activation and deactivation thereof by manual operation is possible. Of course, the printing press 80 can be operated in further functions also as a multi-color printing press and as a perfecting press, wherein it is possible, for example, to consecutively image the printing forms 104, 110 prior to the start of printing. The printing press 80 may comprise further printing units which may be disposed before, between and after the printing units 82, 84.

Figure 2:
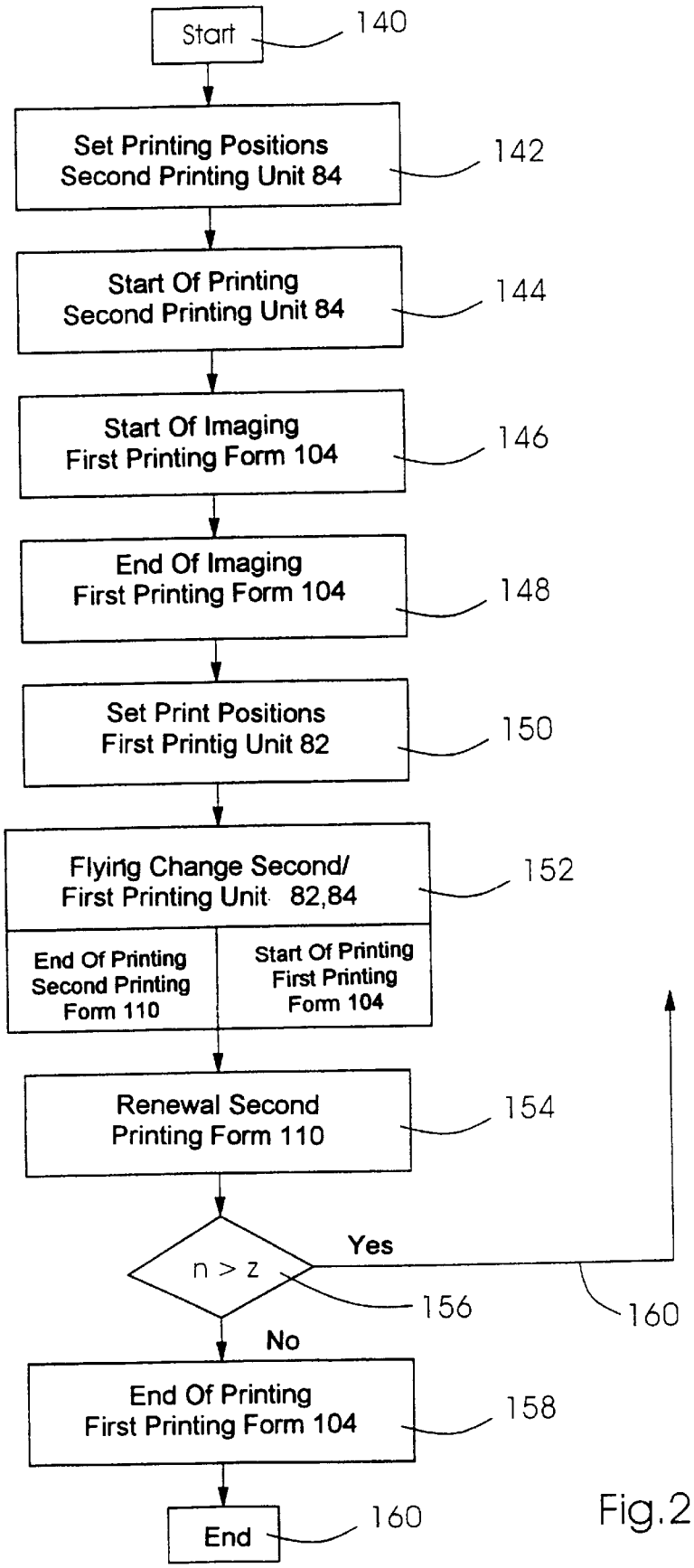
FIG. 2 is a flow diagram schematically illustrating the sequence of control operations of the control of individual printing-press components of the printing press shown in FIG. 1 when carrying out of the method according to the invention.

In a preferred embodiment of the invention, the method according to the invention uses corresponding control software in the central control apparatus 118. The central control apparatus 118 comprises a microprocessor circuit. An example of a flow diagram of such control software is shown in FIG. 2 and is described in the following by way of example with reference to FIG. 1.

After the start of the program at program step 140 by switching on the printing press for example, the printing positions in the second printing unit 84 are set in step 142, wherein, for example the printing-form cylinder 98, which carries an already completely imaged first printing form 110, is brought out of an imaging position into a working position in relation to the rubber-blanket cylinder 100. In the next program step 144, printing is started in the second printing unit 84 of the printing press 80. After the start of printing with the second printing unit 84, the first printing form 104 is imaged in a following program step 146. The imaging is fully completed in a further program step 148, with the result that the first printing form 104 is now imaged and ready for printing. Now, the printing positions in the first printing unit 82 can be set, e.g. in the above-described manner, according to a program step 150. After a first print job with the second printing form 110, contained in the second printing unit 84, has been completed and after the complete production run of the first print job has been printed, a program step 152 follows. In step 152 there is a flying change from the printing with the second printing unit 84 to the printing with the first printing unit 82. In other words, simultaneously with the finishing of the printing with the second printing form 110, the printing of a second print job is started with the first printing form 104. Such a flying change may be effected in that, for example, the rubber-blanket cylinder 94 is brought into engagement first with the inked printing-form cylinder 92 and then with the impression cylinder 96. The rubber-blanket cylinder 100 is meanwhile simultaneously brought out of engagement with the impression cylinder 102 and the printing-form cylinder 98. The printing-form cylinders 92, 98 may be adapted to be coupled to and uncoupled from the drive of the printing press 80 with clutches or couplings. As a result, the non-printing printing-form cylinder 92, 98 can be driven by a further drive at an imaging speed independent of the speed of the printing press.

In a following program step 154, the second printing form 110 is renewed or replaced. This is done for example by manually exchanging a printing-form sleeve or by automatically changing a printing plate or by step-wise winding a windable printing-foil roll, with the result that the printing-form cylinder 98 is provided with a new imageable printing form 110. In a further program step 156, there is a return inquiry, i.e. whether the second print job is followed by further print jobs or whether the number n of jobs to be processed consecutively is greater than the number z of completed jobs. If there is no further print job, then, after the complete production run of the second print job has been printed, it is possible in a following program step 158 to finish printing with the first printing form 104. This is done by bringing the printing-form cylinder 92 out of engagement with the rubber-blanket cylinder 96. If there are further print jobs, e.g. a third print job, then the preceding program steps are repeated, as indicated by the loop 160. The program is terminated in the last program step 161.

Figure 3:
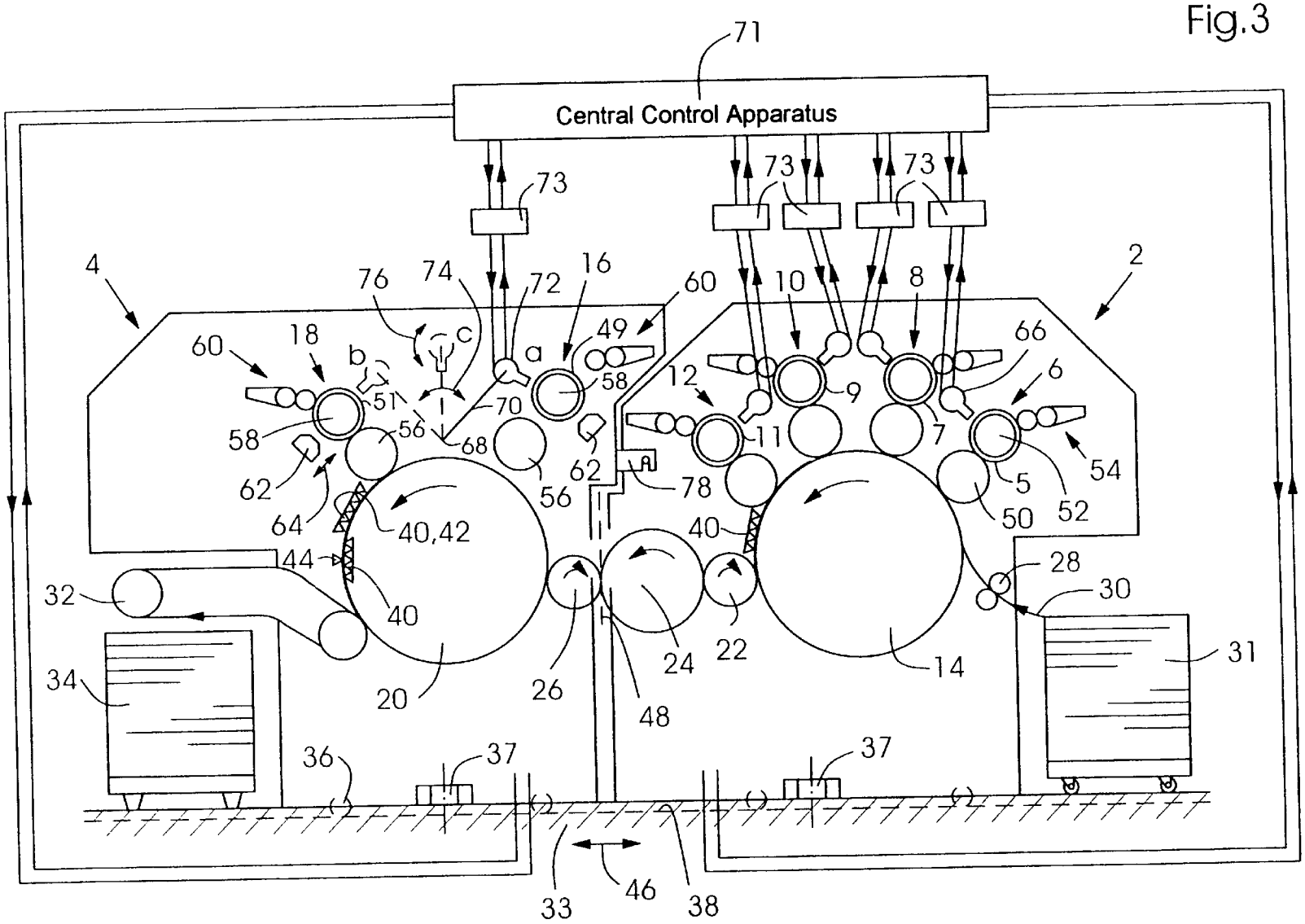
FIG. 3 is a schematic representation of a satellite construction type rotary printing press with a further device for carrying out the method according to the invention.

According to a preferred embodiment of the invention, a rotary printing press is shown in FIG. 3. The rotary printing press comprises a satellite printing unit 2 with four or more printing apparatuses 6, 8, 10, 12 grouped around a multiple-size common impression cylinder 14 and with an imprinting unit 4 with a first imprinting apparatus 16 and a second imprinting apparatus 18. If required, further imprinting apparatuses may be provided. The satellite printing unit 2 and the imprinting unit 4 can be coupled with and uncoupled from each other. The separation point 48 of coupling extending between the single-size, second transfer drum 26 and the double-size—i.e. carrying two sheets at the same time—transfer drum 24, which is preceded by a single-size, first transfer drum 22. The satellite printing unit 2 and the imprinting unit 4 can be coupled together by the connecting element 78, further couplings not being shown in the figure. A drive coupling may be implemented, for example, by an electronic coupling of separate drives of both units 2, 4 by means of the central control apparatus 71. A drive coupling may be also be implemented through the intermediary of a central drive integrated into one of the units 2, 4 and a gear drive, e.g. a gearwheel train, transmitting the drive power of the central drive to the other unit 2, 4.

At least one of the units 2, 4 is displaceable in a direction 46, while the other unit 2, 4 may be fixed in a stationary manner in the foundation 33. The displaceability of the units 2, 4 may be achieved by rollers 36 guided in rails 38 or by other guides which facilitate displacement. The displaceable units 2, 4 may be locked in the foundation 33 by means of locking elements 37.

The existing possibility of separation and coupling permits the coupling of the units 2, 4 and operation with further modules, e.g. sheet-feeding and sheet-delivering as well as further-processing modules—i.e. the application-specific optional combination and also separate operation of the units 2, 4. For example, the satellite printing unit 2 can be combined with an essentially identical or mirror-imaged further satellite printing unit, with the result that two-sided four- or more-color printing or one-sided eight- or more-color printing is possible. The process according to the invention can be implemented either within just one of the satellite printing or imprinting units or across a plurality of modules.

The transfer drums 22, 26 and the transfer drum 24 comprise apparatuses for holding printed sheets, e.g. gripper bars and suction-type grippers. As a result, the printed sheets 30 can be safely guided in position on the circumferential surfaces of the drums 22, 24, 26 and can be transferred from one drum 22, 24 to the other drum 26, 24. The printed sheet transfer apparatus 22, 24, 26 may be convertible and thus be adapted for operation in two operating modes. The printed sheets 30, which are accepted by the sheet-transfer apparatus 22, 24, 26 from the satellite printing unit 2, e.g. directly from the quadruple-size impression cylinder 14 and which carry a printed image on the front side 40, can, in a first operating mode—recto-printing mode—be transferred to the imprinting unit 4, e.g. directly to the multiple-size impression cylinder 20. Thus, imprints can be imprinted on the printed image on the front side 42 by the imprinting unit 4. In a second operating mode—recto- and verso-printing mode—the sheet-transfer apparatus 22, 24, 26 operates as a turning apparatus, the transfer drum 24 acting as a storage drum which cooperates in known manner with the second transfer drum 26 which acts as a turning drum. As a result, the printed sheets 30 are transferred, turned, to the imprinting unit 4, the printed sheets 30 lying front side 40 down on the impression cylinder 20, thereby permitting the rear side 44 to be printed. The arrow points in FIG. 3 symbolize the colors printed onto the sheet on the respective side. FIG. 3 also shows a feeder pile 31 from which sheets 30 may be transported via a sheet feeder 28 and a sheet delivery 32 onto a delivery pile 34.

The method according to the invention can be implemented in various manners with the device show in FIG. 3. In a first variant, one or more imprinting apparatuses 16, 18 of the unit 4 are imaged during printing with the printing apparatuses 5, 7, 9, 11 of the unit 2, or, during printing with one or more of the imprinting apparatuses 16, 18 of the unit 4, one or more printing apparatuses 5, 7, 9, 11 of the unit 2 are imaged. This first variant can also be applied to two coupled satellite printing units. The printing apparatus 5 shown in FIG. 3 is associated with a printing form cylinder 52 and an inking unit 54.

According to a second variant, one or more of the printing forms 5, 7, 9, 11 are imaged during a printing with one or more of the printing forms 5, 7, 9, 11. This variant may be implemented both, in separate operation of the satellite printing unit 2, and, also in operation coupled with other modules, e.g. with the imprinting unit 4.

It is possible to combine these variants with each other and with a below-described preferred third variant and with features mentioned in the description to FIGS. 1 and 2 or shown therein.

The preferred third embodiment includes the implementation of the method according to the invention by means of the devices 62, 70, 72, 73 which are integrated into the imprinting unit 4. The imaging apparatus 72, which is for example embodied as a write head with laser diodes, is adapted to be moved into a first position a for imaging the first printing form 49 and into a second position b for imaging the second printing form 51 as well as, if required, into a neutral position c. This can be effected preferably in that the imaging apparatus 72 is swiveled. The imaging apparatus may preferably be swiveled about a swiveling axis 68. In addition to the swivelling movement 74, the imaging apparatus 72 is able to carry out a further movement 76, if necessary in forced synchronism with the swiveling movement 74.

In the embodiment shown in FIG. 3, each imaging apparatus 66, 72 is associated with a separate imaging control apparatus 73. It is also possible to associate the imaging apparatuses 66, 72 with a common, optionally connectable imaging control apparatus 73 which controls the imaging of the printing forms 5, 7, 9, 11 and the imaging of the printing forms 49, 51.

Furthermore, it is also possible to use one single imaging apparatus 66 with an associated imaging control apparatus 73 for the consecutive imaging of the printing apparatuses 6, 8, 10, 12 or printing forms 5, 7, 9, 11.

FIG. 3 shows that the imprinting apparatus 16 has been taken out of service for imaging. For this purpose the printing-form cylinder 58 and the inking unit 60, the printing-form cylinder 58 and the rubber-blanket cylinder 56 as well as the rubber-blanket cylinder 56 and the impression cylinder 20 have been separated and disengaged from each other. Four-color images of a first part job, printed in the satellite printing unit 2, are provided on the front side 42 of the printed sheet with imprints by the second printing form 51 of the second imprinting apparatus 18. Meanwhile, the first printing form 49 of the first imprinting apparatus 16 is imaged for the imprinting of another imprint image onto four-color images of a second part job. During the printing of the second part job with the first printing form 49, the second printing form 51 can be imaged for a third part job. The used printing form 51 is first replaced by a new imageable printing form. After that the new printing form can be irradiated with the imaging apparatus 72. If necessary, the cleaning device can be positioned 64 for subsequently cleaning the printing form 51.

What is claimed is:

1. A method for operating a rotary printing press, which comprises:

providing first and second printing forms to be imaged in the printing press and adapted to print multiple printed copies upon being imaged once;

printing a first printing job with the first printing form and simultaneously imaging the second printing form in the printing press;

effecting an "on the fly" printing form change; and printing a second printing job with the second printing form.

2. The method according to claim 1, where the first printing job is a partial printing job and the second printing job is a partial printing job.

3. The method according to claim 2, wherein the imaging step comprises locally irradiating the second printing form.

4. The method according to claim 3, which comprises cleaning the first and the second printing forms of imaging residues after the respective irradiating step thereby activating a printing layer of the image locations of the printing forms.

5. The method according to claim 2, which comprises cleaning the first and the second printing forms of imaging residues after the respective irradiating step thereby activating a printing layer of the image locations of the printing forms.

6. The method according to claim 1, wherein the imaging step comprises locally irradiating the second printing form.

7. The method according to claim 6, which comprises cleaning the first and the second printing forms of imaging residues after the respective irradiating step thereby activating a printing layer of the image locations of the printing forms.

8. An apparatus for operating a rotary printing press, which comprises:

first and second printing forms which can be provided with images in the printing press and with which, after being provided with images a single time, multiple printed copies can be made, for performing the method of claim 1, in a rotary printing press;

the first printing form and the second printing form are assigned a single common imaging device, by means of which the second printing form can be provided with images during the printing with the first printing form and said imaging device includes a laser writing head.

9. The device according to claim 8, wherein said common imaging apparatus is movable selectively into a first position for imaging said first printing form and into a second position for imaging said second printing form.

10. The device according to claim 8, wherein said common imaging apparatus is pivotally movable selectively into the first position and the second position.

11. A multi-color sheet-fed offset rotary printing press including the device according to claim 8.

12. The method according to claim 1, which comprises cleaning the first and the second printing forms from imaging residues after the respective irradiating step thereby activating a printing layer of the image locations of the printing forms.

13. A method for operating a rotary printing press, which comprises:

providing at least two printing forms which can be provided with images in the printing press and with which, after being provided with images a single time, multiple printed copies can be made;

printing a first printing job and a second printing job with the printing forms, and during the printing of the first printing job with the first printing form, providing the second printing form for printing the second printing job with images, effecting a change of printing forms "on the fly" between the use of the first printing form for printing the first printing job and the use of the second printing form for printing the second printing job, and imaging the printing forms by local irradiation.

14. The method according to claim 13, which comprises cleaning the first and the second printing forms of imaging residues after the respective irradiating step thereby activating a printing layer of the image locations of the printing forms.

15. A method for operating a rotary printing press, which comprises:

providing at least two printing forms which can be provided with images in the printing press and with which, after being provided with images a single time, multiple printed copies can be made;

printing a total job composed of a first partial job and a second partial job with the printing forms;

during the printing of the first partial job with the first printing form, providing the second printing form for printing the second partial job with images;

effecting a change of printing forms "on the fly" between the use of the first printing form for printing the first partial job and the use of the second printing form for printing the second partial job; and imaging the printing forms by local irradiation.

16. The method according to claim 15, which comprises cleaning the first and the second printing forms of imaging residues after the respective irradiating step thereby activating a printing layer of the image locations of the printing forms.

17. An apparatus for operating a rotary printing press, which comprises:

first and second printing forms which can be provided with images in the printing press and with which, after being provided with images a single time, multiple printed copies can be made;

a first imaging device assigned to the first printing form, and a second imaging device assigned to the second printing form for providing the second printing form with images during the printing using the first printing form.

18. The device according to claim 17, wherein said first and said second imaging apparatuses each include a laser write head.

19. A multi-color sheet-fed offset rotary printing press including the device according to claim 17.

* * * * *